United States Patent [19]

Beshore

[11] Patent Number: 4,780,110

[45] Date of Patent: Oct. 25, 1988

[54] LOW SULFUR AND ASH FUEL COMPOSITION

[75] Inventor: David G. Beshore, St. Petersburg, Fla.

[73] Assignee: Electric Fuels Corporation, St. Petersburg, Fla.

[21] Appl. No.: 73,218

[22] Filed: Jul. 14, 1987

[51] Int. Cl.[4] ..... C10L 1/32

[52] U.S. Cl. ..... 44/51; 44/78

[58] Field of Search ..... 44/51, 78

[56] References Cited

U.S. PATENT DOCUMENTS

| | | | |
|---|---|---|---|
| 2,754,267 | 7/1956 | Bondi | 44/51 |
| 2,780,538 | 2/1957 | Chilton | 44/51 |
| 3,620,698 | 12/1968 | Schlinger et al. | 44/51 |
| 3,764,547 | 10/1973 | Schlinger et al. | 44/51 |
| 4,145,189 | 3/1979 | Solbakken | 44/51 |
| 4,165,969 | 8/1979 | Hughes et al. | 44/51 |
| 4,199,326 | 4/1980 | Fung | 44/51 |
| 4,276,054 | 6/1981 | Schmolka et al. | 44/51 |
| 4,326,855 | 4/1982 | Cottell | 44/51 |
| 4,378,230 | 3/1983 | Rhee | 44/51 |
| 4,455,149 | 6/1984 | Satake et al. | 44/51 |
| 4,511,365 | 4/1985 | Mark | 44/51 |
| 4,601,729 | 7/1986 | Capes et al. | 44/51 |
| 4,618,348 | 10/1986 | Hayes et al. | 44/51 |

FOREIGN PATENT DOCUMENTS

| | | |
|---|---|---|
| 731551 | 5/1966 | Canada . |
| 1168869 | 12/1984 | Canada . |
| 2538407 | 6/1982 | France . |
| 53-45803 | 9/1978 | Japan . |
| 60-6788 | 1/1985 | Japan . |
| 82/01376 | 4/1982 | PCT Int'l Appl. . |

*Primary Examiner*—William R. Dixon, Jr.
*Assistant Examiner*—Margaret B. Medley
*Attorney, Agent, or Firm*—James W. Hellwege

[57] ABSTRACT

An improved low sulfur and ash pumpable fuel composition is provided comprised of a mixture of carbon black in fuel oil dispersed in an aqueous continuous phase, said mixture comprising from about 50 to about 80 weight percent of said fuel composition and said carbon black being present in said fuel composition in an amount of at least about 20 percent by weight. A method for the production of the noted fuel composition is also provided.

15 Claims, 3 Drawing Sheets

LOW SULFUR AND ASH FUEL COMPOSITION

BACKGROUND OF THE PRESENT INVENTION

The present invention is directed to an improved fuel composition comprised of carbon black admixed with a fuel oil with the carbon black-fuel oil admixture being dispersed in an aqueous continuous phase.

Fuel compositions comprised of oil/water dispersions are known, with such dispersions comprising either oil-in-water (o/w) dispersions or water-in-oil (w/o) dispersions.

Exemplary oil-in-water dispersions are disclosed by Canadian Pat. No. 731,551; Japanese patent publication No. 53-45803; and U.S. Pat. Nos. 4,199,326; 4,378,230; 4,455,149; and 4,618,348. It is also known to incorporate a solid carbonaceous component such as char in an oil and water-containing fuel composition as taught by U.S. Pat. No. 4,145,189. The patent teaches that the amount of char which may be employed may be 50 percent by weight or more.

However, a need exists for the production of an improved fuel composition which contains low amounts of sulfur and ash yet can be produced from fuels (e.g., coal or fuel oils) which contain significant amounts of sulfur and/or ash and would thus otherwise generate undesirable combustion products.

A need also exists for the method of production of a particulate carbon-containing aqueous fuel composition which contains up to about 80 percent by weight of a fuel component.

OBJECTS AND SUMMARY OF THE PRESENT INVENTION

It is thus an object of the present invention to provide an improved fuel composition which generates low amounts of undesirable combustion products.

It is further an object of the present invention to provide an improved fuel composition which is derived from fuels which contain significant amounts of sulfur and/or ash.

It is further an object of the present invention to provide an improved fuel composition comprised of fuel oil and water.

It is still further an object of the present invention to provide an improved fuel composition which contains highly desirable amounts of particulate carbon.

In accordance with the present invention, there is provided an improved low sulfur, low ash, pumpable fuel composition comprised of carbon black admixed with fuel oil with the carbon black-fuel oil admixture dispersed in an aqueous continuous phase, said carbon black-fuel oil admixture comprising from about 50 to about 80 weight percent of said fuel composition and said carbon black being present in said fuel composition in an amount in the range of from about 20 to about 55 weight percent.

In accordance with the present invention, there is also provided an improved method for the production of an improved low sulfur and ash pumpable fuel composition comprised of carbon black admixed with fuel oil with the carbon black-fuel oil admixture dispersed in an aqueous continuous phase, said method comprising admixing carbon black with a fuel oil to form a substantially uniform admixture thereof with the weight ratio of said carbon black to said fuel oil ranging from about 1:3 to about 2:1, and subsequently dispersing said carbon black-fuel oil admixture in an aqueous phase to yield said admixture of carbon black and fuel oil dispersed in an aqueous continuous phase.

DETAILED DESCRIPTION OF THE INVENTION

Figure 1:
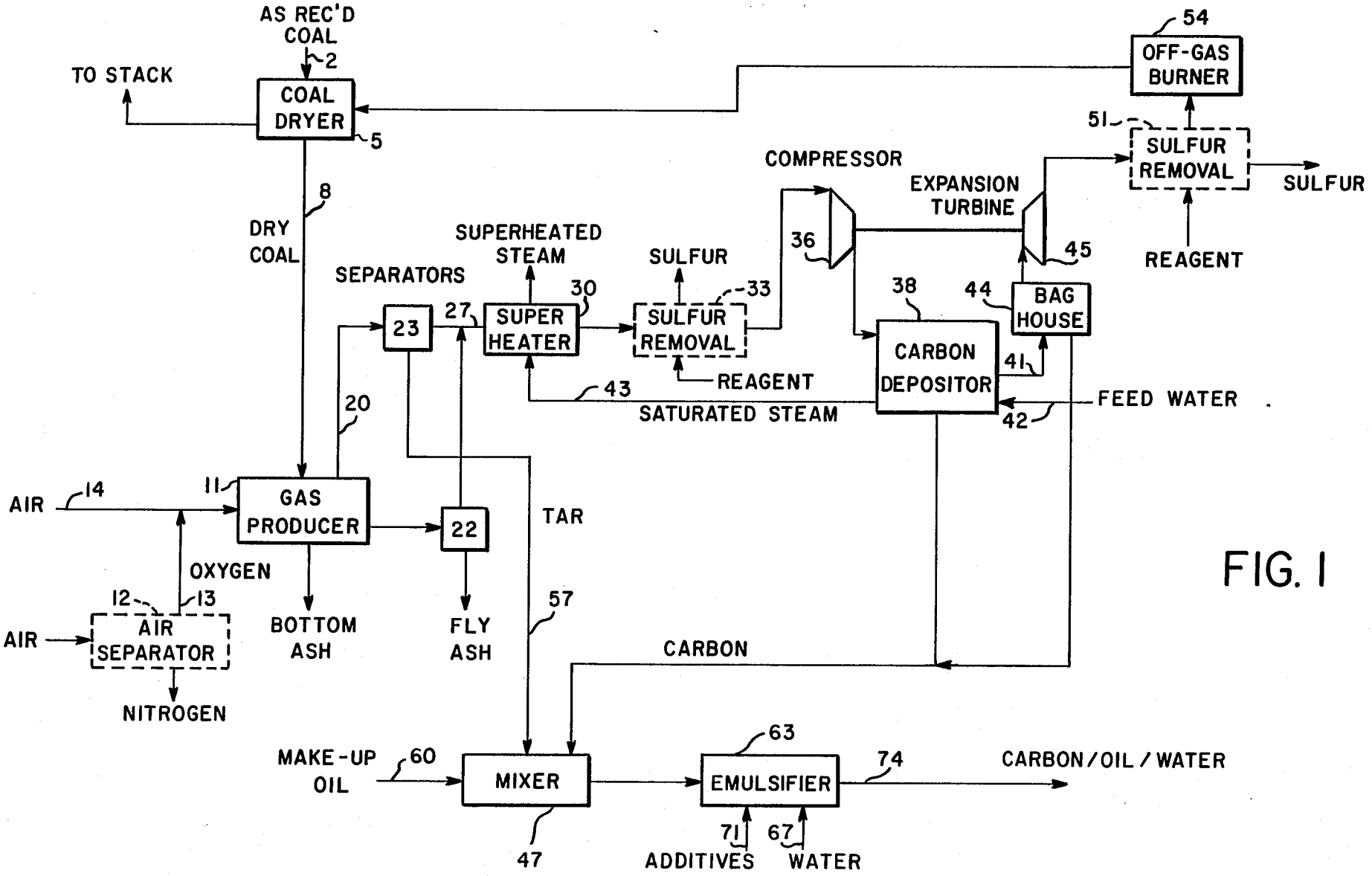
FIG. 1 schematically depicts one method for the production of the improved fuel composition of the present invention. With this particular method, carbon black is produced from the gasification of dried coal. In this case the gasification occurs in an above-ground atmospheric vessel (gas producer) to promote the production of carbon monoxide with sub-stoichiometric air or oxygen. Other gasification schemes may be developed to produce carbon monoxide-rich gasification products. For example, underground gasification of coal, oil shale, or heavy bitumen may be employed which uses the same downstream processing equipment as shown in FIG. 1 and described below.

It has been found that a highly desirable fuel composition can be provided in the form of a mixture of carbon black admixed with fuel oil with the carbon black-fuel oil admixture dispersed in an aqueous continuous phase, the admixture comprising from about 50 to about 80 weight percent of said fuel composition and the carbon black being present in said fuel composition in an amount in the range of from about 20 to about 55 weight percent.

The term "dispersion" as employed in conjunction with the present invention is intended to have the same meaning as "emulsion", with the fuel composition of the present invention comprising an oil-in-water dispersion with the oil phase comprising a mixture of carbon black in a fuel oil. In such a dispersion the water constitutes the continuous phase and the carbon black-containing oil constitutes the discontinuous or disperse phase.

The carbon black is present in the fuel composition in an amount of at least about 20 percent by weight, and preferably in an amount ranging from about 30 to about 45 percent by weight. The fuel oil component is present in the fuel composition in an amount ranging from about 20 to about 60 percent by weight. The carbon black is preferably present in a weight ratio of carbon black to fuel oil of from about 1:3 to about 2:1. The aqueous component of the fuel composition is present in an amount ranging from about 20 to about 50 percent by weight, all of such percentages based on the total weight of the fuel composition.

The carbon black component inherently contains low amounts of sulfur and ash. Carbon black by definition is a finely divided form of carbon produced by the incomplete combustion or thermal decomposition of a carbonaceous material such as coal or petroleum oils. Carbon black exhibits an extremely low volatile content and as such is not readily susceptible to combustion. Carbon black thus has not found acceptability as a fuel source. The carbon black employed in the fuel composition of the present invention has a size in the range of from about 0.01 to about 20 microns, and preferably has a size in the range of from about 0.1 to about 10 microns.

The carbon black component of the fuel composition may be produced by any suitable process. For example, carbon black may be produced by the low pressure gasification of coal to yield the maximum amount of carbon monoxide, tars and light oils. The carbon monoxide-containing gases thus produced are passed to a carbon deposition zone where particulate carbon black is caused to be formed by disproportionation via the reaction of 2CO (gas)→C(solid)+$CO_2$ (gas) at an average temperature ranging from about 260° to 375° C. Such processes are known as evidenced by the teachings of U.S. Pat. Nos. 3,861,885 and 4,185,083, the teachings of each being incorporated herein by reference in their entirety.

The fuel oil component may consist of various types of fuel oils or mixtures thereof. Exemplary types of fuel oils which are suitable for use in the present invention include but are not limited to Nos. 1, 2, 3, 4, 5 and 6 grade fuel oils and mixtures thereof, petroleum residuum, crude oil, shale oil, coke oven tars and bitumen.

In order to attain the objects of the present invention it is important that an oil-in-water dispersion be formed with the oil component containing major amounts of the carbon black. Such an embodiment is in contrast to a fuel composition wherein the carbon black and the fuel oil component may be separately dispersed within the aqueous component. Instead, the fuel composition of the present invention comprises carbon black-containing oil droplets dispersed in a water phase.

The preparation of the oil-in-water dispersion of the present invention will be further discussed in conjunction with FIG. 1. Crushed or pulverized coal 2 is dried in drier 5 with the dried coal 8 being fed to gas producer 11. The gas producer may comprise a low pressure gasification zone into which air 14 may be fed optionally in admixture with oxygen-enriched air 13 derived from an air separation stage 12. Carbon monoxide-containing gases 20 formed in the gas producer are recovered and separated from low molecular weight tars in separator 23. Ash and other particulates are separated in a separate unit 22. The resulting carbon-monoxide gas 27 is cooled in steam superheater 30 to about 550° C., desulfurized in desulfurization zone 33, compressed to about 100 psig in compressor 36 and passed to a carbon deposition zone 39. In the carbon deposition zone the carbon monoxide is disproportionated to yield carbon black and carbon dioxide. The gases in this zone are cooled to about 260° to 320° C. while heating water 42 to steam 43 to be superheated in superheater 30 for use in power generation.

Carbon black is separated from the off-gases 41 from the carbon depositor 39 at bag house 44, with the recovered carbon black being passed to mixing zone 47. The recovered off-gases from the carbon depositer are decompressed from about 100 psig to 0 psig with an expansion turbine 45 coupled to the compressor 36 to conserve mechanical energy. The decompressed gas may then be desulfurized at desulfurization zone 51. Such gases, which may contain some residual carbon monoxide (CO), may be combusted in the off-gas burner 54. The thermal energy in the combustion products provides heat for drier 5.

The recovered carbon black can then be admixed with tar byproducts 57 recovered from the gas producer zone as well as separately supplied make-up fuel oil 60 in weight ratios ranging from about 1:3 to about 2:1 carbon black to oil. The carbon black-fuel oil admixture 60 is subsequently fed to emulsification zone 63 wherein the carbon black-fuel oil admixture is emulsified or dispersed with water 67 preferably in the presence of a suitable surfactant 71.

The resulting carbon-in-oil-in-water dispersion 74 is then recovered and may be employed as a fuel in a conventional manner. For example, the fuel composition of the present invention may be readily substituted for Nos. 2, 4, 5 and 6 fuel oils normally employed.

The above-described process is not limited in concept to the use of coal as the feedstock for the gas producer zone. Petroleum or petroleum-derived oils, shale oil, tar sands, and gaseous fuels may also be employed. However, it is preferred that the feedstock possess a high carbon-to-hydrogen atom ratio (e.g., at least about 0.6) to maximize the amount of carbon black ultimately produced. Various types of coals, having carbon-to-hydrogen ratios on the order of at least 1.0, are thus the preferred feedstock for the gas producer zone.

Various surfactants are employed to enhance the formation of the dispersion and enable a storage-stable emulsion of low viscosity to be formed. It has also been found that the amount of surfactant employed is less than would be normally employed for a carbon black-in-water emulsion. The reduction in the amount of the surfactant results from the increased size of the oil droplets due to the presence of the particulate carbon black within the droplets.

Exemplary surfactant compositions which may be employed are described in the literature, with specific reference made herein to the disclosure of Canadian Pat. No. 731,551, and U.S. Pat. No. 4,511,365, herein incorporated by reference in their entirety with regard to such discussions. Preferred surfactants for use in the production of the fuel composition of the present invention include but are not limited to polyoxyethylene alkylphenols, and are available commercially from Rohm and Haas under the Triton X series tradename. Preferred surfactants are believed to constitute those conventionally employed in coal-water slurries.

The amount of a surfactant which may be employed will, of course, vary as a result of the specific surfactant employed and the specific physical properties to be achieved. One skilled in the art can readily determine the relative amounts of surfactants to be employed. However, it is preferred that the surfactant component of the fuel composition be present in an amount ranging from about 0.2 to 2.0 percent by weight based on the weight of the fuel composition. The surfactant, during the preparation of the fuel composition of the present invention, is added to the aqueous continuous phase prior to the dispersion of the carbon black-oil admixture in the aqueous continuous phase.

The dispersion of the carbon black within the fuel oil may be accomplished by any conventional solids/liquids mixing process. For example, such mixing may be accomplished by means of low shear propellor mixing (<500 rpm).

The dispersion of the carbon black-oil admixture within the aqueous phase may be accomplished by use of conventional disperser or colloid mill devices which provide the desired high shear mixing. Such devices include but are not limited to rotor-stator type disperser devices. For example, the Kady Mill disperser of Kinetic Dispersion Company (Scarborough, Maine), the Dispax disperser of Tekmar Company (Cincinnati, Ohio) and the Charlotte colloidal mill (Chemicolloid Laboratories, Inc.) are suitable for use in the present invention. Additional dispersers known to those skilled in the art which enable high shear mixing to be achieved and the desired colloidal dispersion to be prepared may also be employed with success.

The advantages of the fuel composition of the present invention are several. Of primary importance is the fact that the present invention enables surprisingly large amounts of particulate carbon black to be incorporated into the liquid fuel composition while still permitting the fuel to exhibit acceptable viscosity and stability characteristics. For example, the fuel composition desirably may exhibit a viscosity of less than 300 centipoise at 40° C.

Further, the poor combustion characteristics of carbon black are overcome by the presence of volatile fuel oils within the composition. Such advantages are in contrast to the difficulties which result from an attempt to provide an acceptable fuel based solely upon carbon black and water. $NO_x$ emissions are also reduced as a result of the presence of water within the composition. Water in the fuel lowers the flame temperature which in turn lowers thermally-produced $NO_x$ emissions. Also, a fuel composition which comprises less than about 0.5 percent by weight of ash and less than 1.0 percent by weight of sulfur may be produced.

The invention is additionally illustrated in connection with the following Example which is to be considered as illustrative of the present invention. It should be understood, however, that the invention is not limited to the specific details of the Example.

EXAMPLE

A fuel composition according to the present invention comprised of carbon black, No. 2 fuel oil, and water was produced having the composition identified below:

| | Percent By Weight |
|---|---|
| Carbon Black | 22.6 |
| No. 2 Oil | 46.4 |
| Water | 30.2 |
| Surfactant | 0.8 |
| TOTAL | 100.0 |

Figure 2:
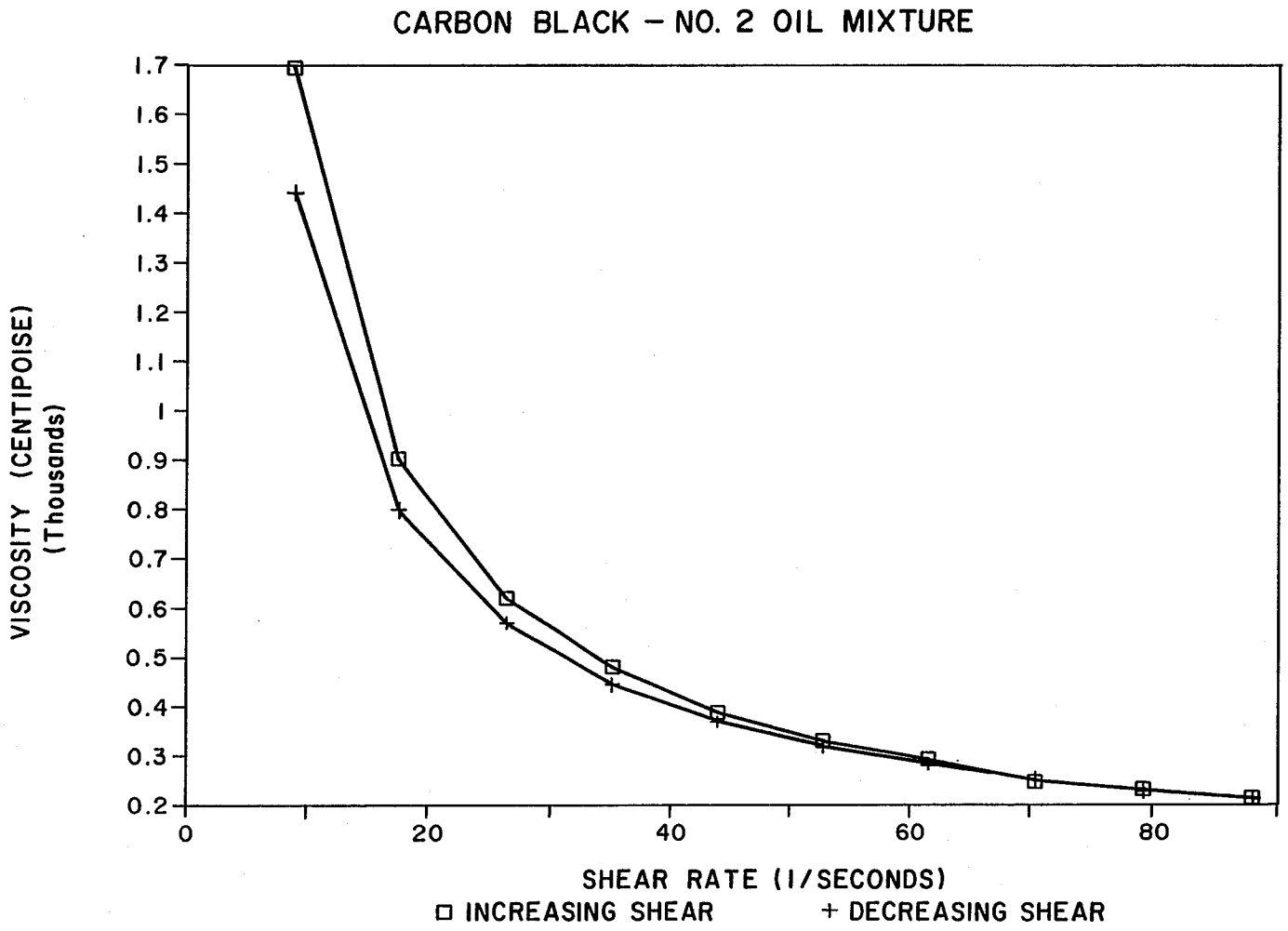
FIG. 2 is a viscosity diagram for a carbon black-in-oil dispersion.

The mixture was prepared by first mixing carbon black with oil to form a carbon black-in-oil mixture containing about 37% by weight carbon black. At this point the mixture became very viscous and was unable to become further mixed with a high speed, high shear mixer. The viscosity-shear characteristics of the carbon black-in-oil admixture (as measured by a Haake Rotovisco RV-2 instrument at 21° C.) are summarized in Table 1 below as well as FIG. 2:

TABLE 1

CARBON BLACK-OIL ADMIXTURE VISCOSITY CHARACTERISTICS

| Shear Stress (Pascals) | Shear Rate (Sec-1) | Viscosity (Millipascal · Seconds) |
|---|---|---|
| | Increasing Shear Rate | |
| 11.725 | 0 | Yield Point |
| 14.908 | 8.80 | 1692.34 |
| 15.913 | 17.60 | 903.21 |
| 16.415 | 26.40 | 621.16 |
| 16.918 | 35.20 | 480.13 |
| 17.253 | 44.00 | 391.71 |
| 17.588 | 52.80 | 332.76 |
| 18.090 | 61.60 | 293.37 |
| 17.588 | 70.40 | 249.57 |
| 18.760 | 79.20 | 236.63 |

TABLE 1-continued

CARBON BLACK-OIL ADMIXTURE VISCOSITY CHARACTERISTICS

| Shear Stress (Pascals) | Shear Rate (Sec-1) | Viscosity (Millipascal · Seconds) |
|---|---|---|
| 19.095 | 88.00 | 216.77 |
| | Decreasing Shear Rate | |
| 9.213 | 0 | Yield Point |
| 12.730 | 8.80 | 1445.14 |
| 14.070 | 17.60 | 798.63 |
| 15.075 | 26.40 | 570.45 |
| 15.745 | 35.20 | 446.85 |
| 16.415 | 44.00 | 372.69 |
| 16.918 | 52.80 | 320.09 |
| 17.588 | 61.60 | 285.23 |
| 17.923 | 70.40 | 254.33 |
| 18.425 | 79.20 | 232.41 |
| 19.095 | 88.00 | 216.77 |

Figure 3:
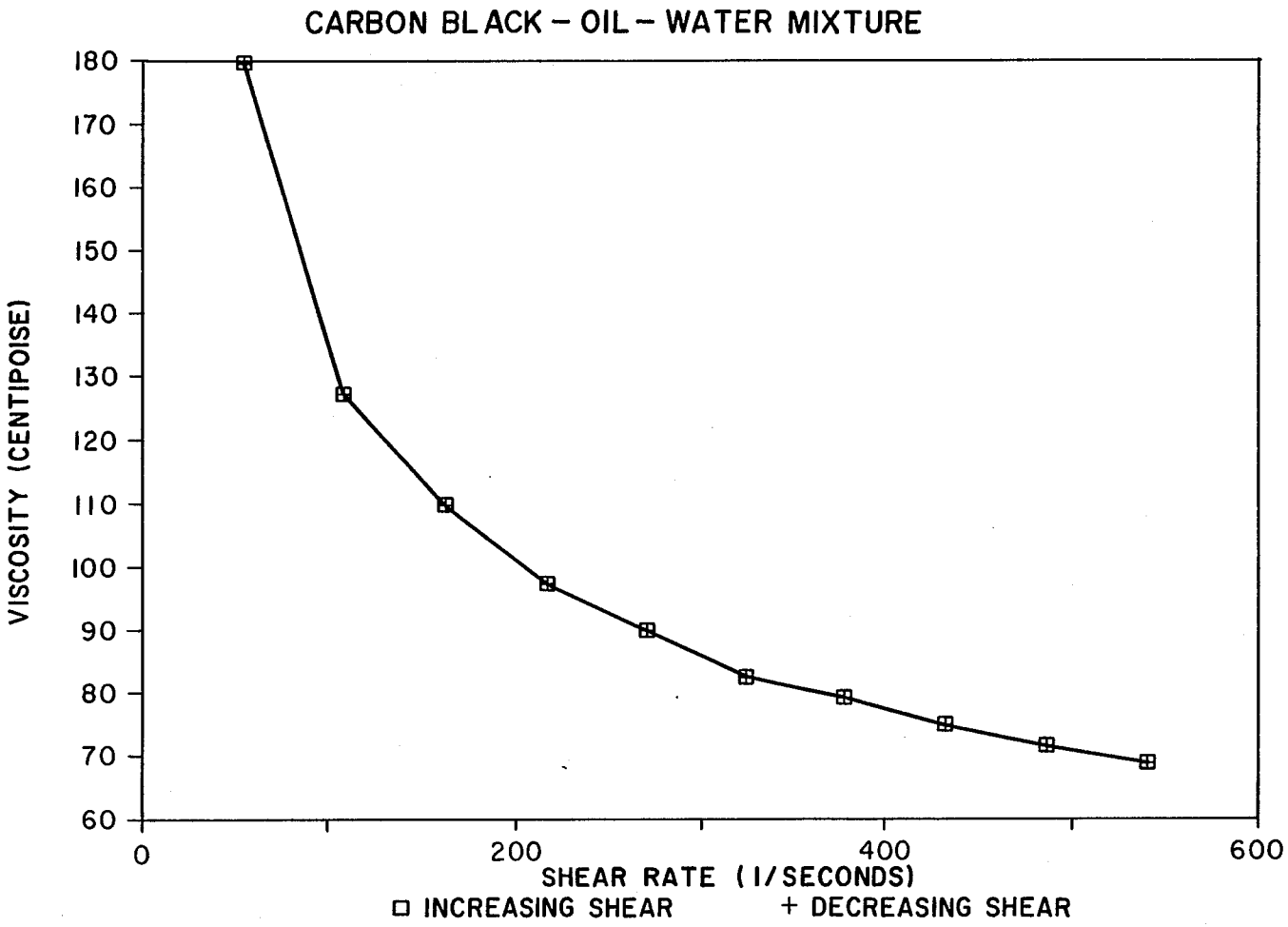
FIG. 3 is a viscosity diagram for a carbon black-in-oil-in-water dispersion.

This viscous mixture was then dispersed in water in the presence of a surfactant additive to achieve the final composition of Table 1, with the surfactant being nonionic by nature (a polyoxyethylene condensate of an octylphenol). The viscosity of this mixture was much lower after emulsifying in water. The viscosity-shear characteristics of the carbon black-in-oil-in-water dispersion are summarized in Table 2 below as well as FIG. 3:

TABLE 2

CARBON BLACK-OIL-WATER ADMIXTURE VISCOSITY CHARACTERISTICS

| Shear Stress (Pascals) | Shear Rate (Sec-1) | Viscosity (Millipascal · Seconds) |
|---|---|---|
| | Increasing Shear Rate | |
| 0 | 0 | — |
| 9.720 | 54.10 | 179.58 |
| 13.770 | 108.20 | 127.20 |
| 17.820 | 162.30 | 109.74 |
| 21.060 | 216.40 | 97.27 |
| 24.300 | 270.50 | 89.79 |
| 26.730 | 324.60 | 82.31 |
| 29.970 | 378.70 | 79.10 |
| 32.400 | 432.80 | 74.83 |
| 34.830 | 486.90 | 71.50 |
| 37.260 | 541.00 | 68.84 |
| | Decreasing Shear Rate | |
| 0 | 0 | — |
| 9.720 | 54.10 | 179.58 |
| 13.770 | 108.20 | 127.20 |
| 17.820 | 162.30 | 109.74 |
| 21.060 | 216.40 | 97.27 |
| 24.300 | 270.50 | 89.79 |
| 26.730 | 324.60 | 82.31 |
| 29.970 | 378.70 | 79.10 |
| 32.400 | 432.80 | 74.83 |
| 34.830 | 486.90 | 71.50 |
| 37.260 | 541.00 | 68.84 |

At low shear rates ($<100$ seconds$^{-1}$) the carbon black-in-oil-in-water mixture exhibited viscosities less than 200 centipoise (200 milliPascal.seconds). The waterless carbon black-oil mixture, however, exhibited viscosities higher than 1000 centipose (100 milliPascal.-seconds) together with a pronounced yield point of 11.73 pascals. The high yield point of the waterless carbon black-oil mixture renders the mix unusable from the standpoint of storage and handling. By contrast, the carbon black-in-oil-in-water emulsion exhibited no yield point. Storage tests of the carbon black-oil-water emulsion indicate minimal if any separation of constituents even after several months of storage life.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. An improved low sulfur and ash pumpable fuel composition comprised of a carbon black-fuel oil admixture dispersed in an aqueous continuous phase, said carbon black-fuel oil admixture comprising from about 50 to about 80 weight percent of said fuel composition, said carbon black being present in said fuel composition in an amount of at least about 20 percent by weight and the weight ratio of said carbon black to said fuel oil ranging from about 1:3 to about 2:1.

2. The improved fuel composition of claim 1 wherein said carbon black is present in an amount ranging from about 20 to 55 weight percent of said fuel composition.

3. The improved fuel composition of claim 1 wherein said fuel oil comprises from about 20 to 60 percent by weight of said fuel composition.

4. The improved fuel composition of claim 1 exhibiting a viscosity of less than 300 centipoise at 40° C.

5. The improved fuel composition of claim 1 wherein said fuel oil is selected from the group consisting of Nos. 1, 2, 3, 4, 5 and 6 grade fuel oils and mixtures thereof, petroleum residuum, crude oil, shale oil, coke oven tars and bitumen.

6. The improved fuel composition of claim 1 wherein said carbon black possesses a size in the range of from about 0.01 to about 20 microns.

7. The improved fuel composition of claim 1 wherein said carbon black comprises from about 30 to about 45 percent by weight of said fuel composition.

8. The improved fuel composition of claim 1 further comprising a surfactant.

9. A method for the production of an improved low sulfur and ash pumpable fuel composition comprised of a carbon black-fuel oil admixture dispersed in an aqueous continuous phase, said method comprising admixing carbon black with a fuel oil to form a substantially uniform admixture thereof with the weight ratio of said carbon black to said fuel oil ranging from about 1:3 to about 2:1, and subsequently dispersing said carbon black-fuel oil admixture in an aqueous phase to yield said admixture of carbon black and fuel oil dispersed in an aqueous continuous phase, said carbon black-fuel oil admixture being present in said fuel composition in an amount ranging from about 50 to about 80 percent by weight and said carbon black being present in said fuel composition in an amount of at least about 20 percent by weight.

10. The method for the production of an improved fuel composition of claim 9 wherein said carbon black is present in an amount ranging from about 20 to 55 weight percent.

11. The method for the production of an improved fuel composition of claim 9 wherein said fuel oil comprises from about 20 to 60 percent by weight of said fuel composition.

12. The method for the production of an improved fuel composition of claim 9 wherein said fuel oil is selected from the group consisting of Nos. 1, 2, 3, 4, 5 and 6 grade fuel oils and mixtures thereof, petroleum residuum, crude oil, shale oil, coke oven tars and bitumen.

13. The method for the production of an improved fuel composition of claim 9 wherein said carbon black possesses a size in the range of from about 0.01 to about 20 microns.

14. The method for the production of an improved fuel composition of claim 9 wherein said carbon black comprises from about 30 to about 45 percent by weight of said fuel composition.

15. The method for the production of an improved fuel composition of claim 9 further comprising admixing a surfactant with the aqueous continuous phase prior to the dispersal of the carbon black-fuel oil admixture therein.

* * * * *